United States Patent [19]

Duarte

[11] 3,999,501

[45] Dec. 28, 1976

[54] KNOCKDOWN READILY PORTABLE RIDER PROPELLED WATER SCOOTER AND LIFE RAFT

[76] Inventor: Jose Duarte, 6910 W. 2nd Lane, Hialeah, Fla. 33014

[22] Filed: Aug. 25, 1975

[21] Appl. No.: 607,719

[52] U.S. Cl. ..... 115/23

[51] Int. Cl.[2] ..... B63H 16/00; B63H 16/12

[58] Field of Search ..... 115/21, 22.1, 22, 22.2, 115/22.3, 23, 25, 26, 26.1, 26.3, 27, 49–54; 416/197; 285/303; 9/310 B, 310 E, 310 H, 310 J, 2 F, 2 S, 11 R; D12/68

[56] References Cited

UNITED STATES PATENTS

| | | | |
|---|---|---|---|
| 135,412 | 2/1873 | Denney | 416/197 |
| 481,113 | 8/1892 | Haswell | 115/23 |
| 918,029 | 4/1909 | Ferrari | 115/26.3 |
| 1,071,113 | 8/1913 | Teters | 115/26.1 |
| 1,299,000 | 4/1919 | Moore | 115/26.1 |
| 2,075,649 | 3/1937 | Knight | 9/310 H |
| 2,458,775 | 1/1949 | Giacomelli | 115/22 |
| 2,556,619 | 6/1951 | Hearon | 115/26 |
| 2,685,270 | 8/1954 | Dit Pierac | 115/22 |
| 3,347,575 | 10/1967 | Morris | 285/303 |

FOREIGN PATENTS OR APPLICATIONS

| | | | |
|---|---|---|---|
| 933,157 | 4/1948 | France | 115/23 |
| 1,163,567 | 9/1958 | France | 9/310 H |
| 1,042,443 | 10/1958 | Germany | 115/22.3 |

*Primary Examiner*—George E. A. Halvosa
*Assistant Examiner*—Jesus D. Sotelo
*Attorney, Agent, or Firm*—Gustave Miller

[57] ABSTRACT

A knockdown, readily portable rider propelled water scooter or life raft includes two separate, readily attachable floats that can be manually attached together or disassembled without the use of tools. In assembly, the two floats are adjustably secured together in spaced longitudinal relation, to fit most adult size riders. The forward torso supporting float may also include a viewing window for the rider to look down into the water, and/or a compass for navigation when used as a life raft. A manually controllable rudder is journaled through the forward float, which may also be provided with grommets for supporting canopy poles and a canopy if desired, to shade the human torso. Elongate male and female rods extend from the floats for detachably securing them together by depressible buttons in the male rods and suitably spaced holes in the female rods. A crank shaft is journaled on the attaching rods, with foot cranks having foot receiving stirrups located between the attaching rods and synchronized paddle wheels secured on the outer ends of the crankshaft outside of the attaching rods. A hollow trunk space and trunk lid are provided in the rear float in which some of the knocked down parts may be stored when not in use, and in which personal articles or a survival kit may be carried when in use.

10 Claims, 12 Drawing Figures

KNOCKDOWN READILY PORTABLE RIDER PROPELLED WATER SCOOTER AND LIFE RAFT

OBJECTS OF THE INVENTION

It is an object to provide a rider propelled water scooter or life raft that is easily, manually, knocked down into two separate floats with a rudder and paddle wheels that are also easily separated, all without the use of any tools, and which may likewise be assembled without tools.

A further object of this invention is to provide a scooter or raft that may be separated into parts that easily fit in an automobile trunk of average size.

Yet a further object of this invention is to provide a scooter or life raft that is adjustable in size to fit most adults of various heights.

A further object of this invention is to provide a rider propelled water scooter or life raft having two longitudinally spaced floats readily attachable or detachable by means of a pair of spaced apart complementary male and female rods having umbrella type depressible buttons in the male rods and suitably spaced holes in the female rods for securing the floats in adjusted length, or releasing them for storage and portability.

A further object of this invention is to provide a very efficient paddle wheel having scooped out sharp edged paddles extending from the polygonal surfaces of a polygonel hub, so that when the paddle is rotated, the outer ends of the paddle will enter the water first when the wheel has its journaling center at on above the water line.

A further object of this invention is to provide paddle wheels mounted for operation in synchronism on opposite ends of a crank shaft outside of the attaching rods when journaled on such rods, with foot cranks having stirrups between the attaching rods for comfortable operation by the rider.

A further object of this invention is to provide a water scooter or life raft having longitudinally spaced attachably secured floats, the forward float having a torso supporting beveled upper rear edge and may also have a bottom viewing window, a compass for navigation, and an optionally mountable canopy.

Still a further object of this invention is to provide a water scooter or life raft with a trunk space and lid for carrying personal articles or a survival kit therein.

Yet a further object of this invention is to provide a manually controllable rudder detachably journaled through the forward float for easy operation and assembly or disassembly without using tools.

Another object of this invention is to provide an exercise device for use by both swimmers and non-swimmers in the water in a pool, lake or at the beach.

A still further object of this invention is to provide a sport or exercise device that may be used in competition, as in racing by several riders competing for speed or distance in the water.

A further object of this invention is to provide a water scooter that may be used as a life boat or life raft on a small power boat, so that, if the power boat be disabled, the occupant may pedal himself to safety, with the life raft having a trunk space for carrying survival supplies.

A still further object of this invention is to provide an improved, adjustably sized, knockdown rider propelled water scooter that is a decided improvement over the prior art, as examplified by U.S. Pat. Nos. 1,086,608; 2,403,560; 2,468,889; and 3,874,319.

BRIEF DESCRIPTION OF THE FIGURES

With the above and related objects in view, this invention consists in the details of construction and combination of parts, as will be more fully understood from the following description, when read in conjunction with the accompanying drawings, in which.

DETAILED DESCRIPTION OF THE INVENTION

Figure 1:
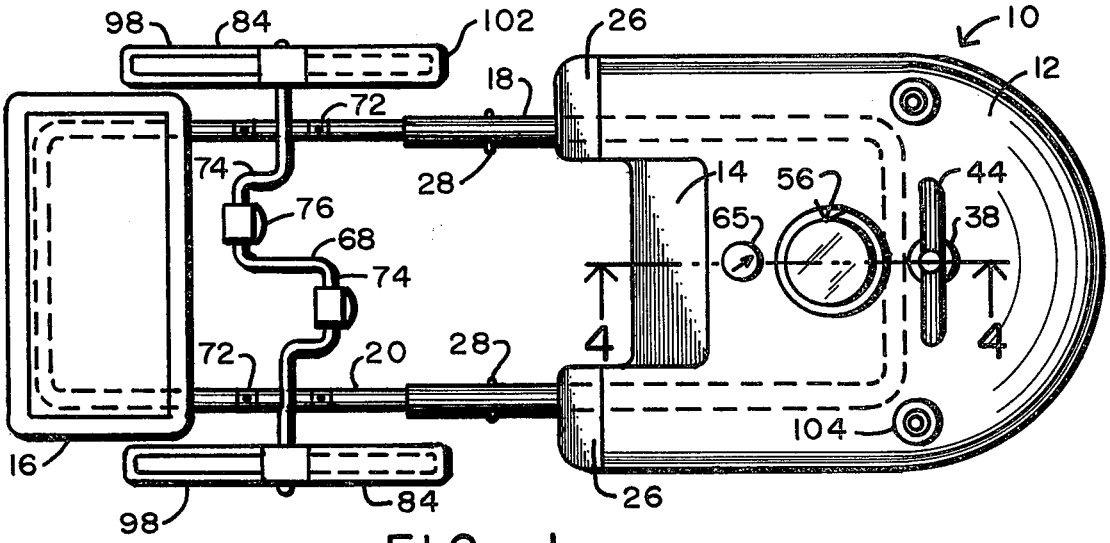
FIG. 1 is a top plan view of the water scooter or life raft of this invention.
Figure 2:
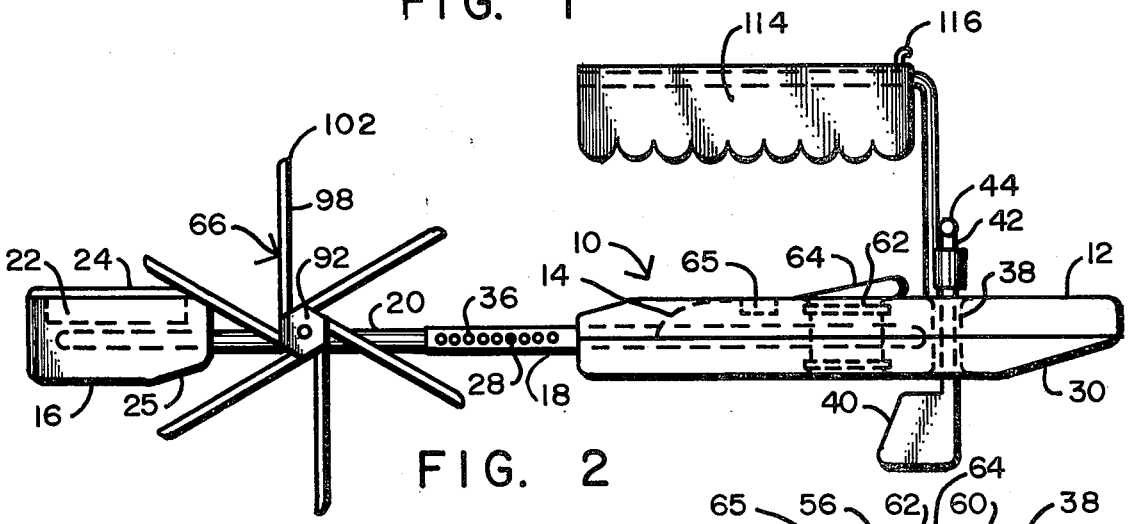
FIG. 2 is a side elevation of FIG. 1.
Figure 3:
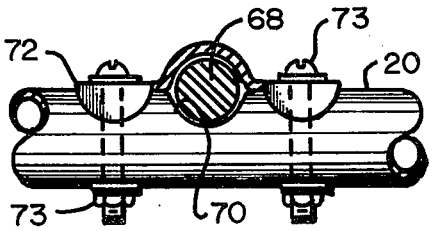
FIG. 3 is a side view showing the mounting of the crank shaft.
Figure 4:
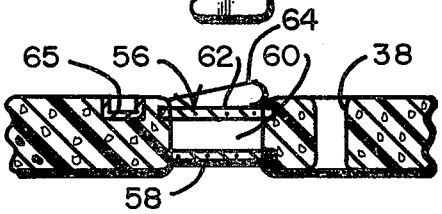
FIG. 4 is a section through the window hole on line 4—4 of FIG. 1.
Figure 5:
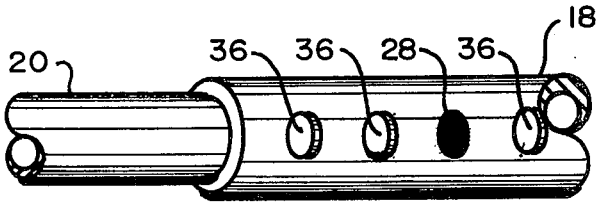
FIG. 5 is a fragmentary side view of the float attaching rods.
Figure 6:
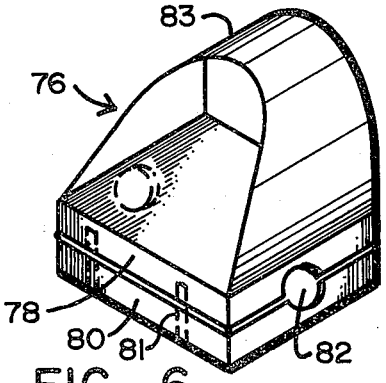
FIG. 6 is an isometric view of the foot stirrup.
Figure 7:
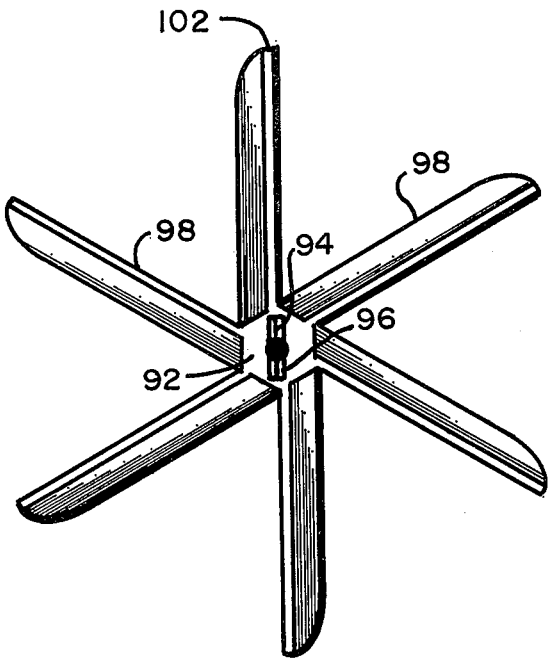
FIG. 7 is a detailed side view of the paddle wheels.
Figure 8:
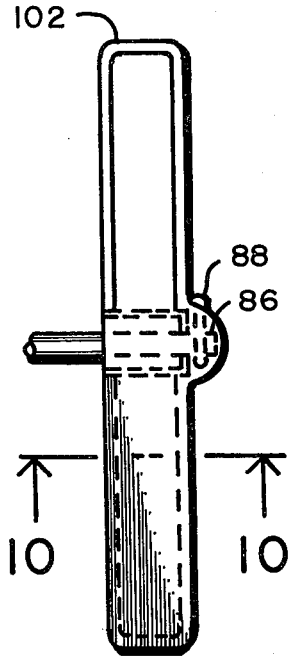
FIG. 8 is a front view of the paddle wheel.
Figure 9:
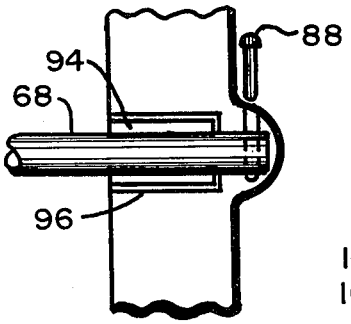
FIG. 9 is a section through the paddle hub.
Figure 10:
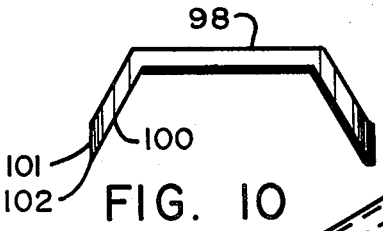
FIG. 10 is a section through the wheel paddle on line 10—10 of FIG. 8.
Figure 11:
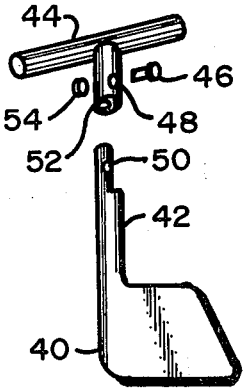
FIG. 11 is an exploded view of the rudder assembly.
Figure 12:
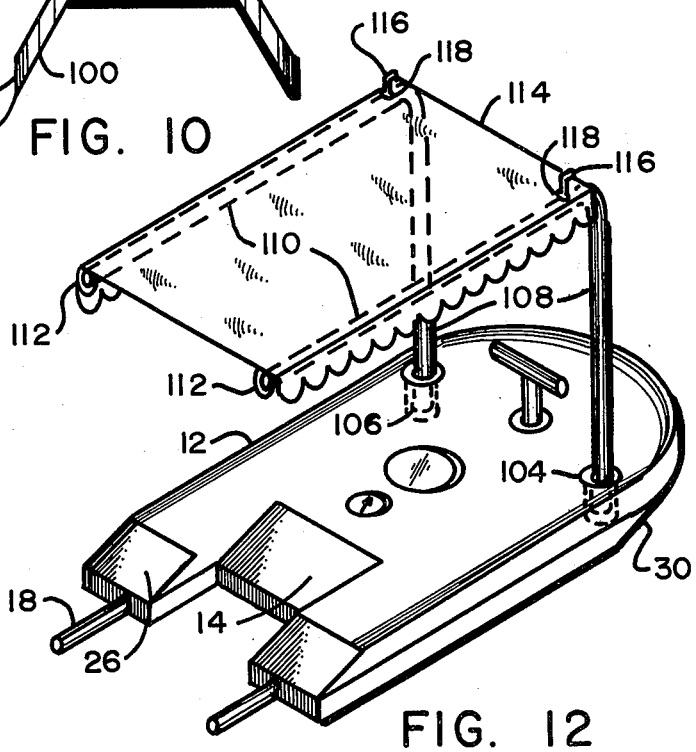
FIG. 12 shows the canopy and its support on the forward float.

There is shown at 10 the assembled knockdown readily portable rider propelled water scooter or life raft of this invention. This water scooter or life raft 10 comprises basically a forward torso supporting front float 12 having a torso supporting rear beveled edge 14, and a separate rear float 16. The floats 12 and 16 have complementary transversely spaced elongate female rods 18 and male rods 20 for manually adjustably attaching the floats 12 and 16 together, or separating them, without the use of any tools whatsoever. The floats 12 and 16 are preferably made of suitable foamed buoyant synthetic material, such as urethane, although wood or other waterproof, buoyant material may be used.

When the floats are of molded material, the elongate rods 16 and 20 may be the legs of U-members molded within the float. The rods may be of aluminum, or even of high impact synthetic plastic material, one example of a suitable material being CYCOLAC, and other parts of this invention may also be made of this material, as will hereinafter be pointed out.

The rear float 16 is preferably provided with a hollowed out trunk space 22 having a snug fitting lid 24 so as to be substantially leakproof, for carrying personal articles or a survival kit when used as a life raft. The forward bottom edge of the rear float 16 is preferably forwardly upwardly bevelled on its bottom, as at 25, while the forward float 12 is beveled on its forward side, as at 30. The rear edges of forward float 12 at the female rods 18 are beveled downwardly, as at 26.

The elongate male attaching rods 20 are adjustably inserted into the elongate female attaching rods 18, into which they fit snugly, and are readily secured therein by one or two yieldably depressible buttons 28 in the male elongate rod 20 outwardly urged by inner springs therebeneath. To attach the male and female rods 18 and 20 together in adjusted position, the male rods 18 are inserted into the female rods 20, and the buttons 28 somewhat rounded at their upper edges may snap past the apertures 36 until they reach the desired set of apertures 36 for the desired size. Obviously, if they fail to snap past, they may be held manually depressed as they are inserted into the female rods 18 and held depressed to pass the apertures 36 until they reach the desired apertures, no tools being thus needed. The same action is done in separating the floats for storage and carrying in an automobile trunk, boat or elsewhere, the floats, when separated, fitting easily in the usual automobile trunk or any convenient space in a boat.

The forward float 12 is provided with a suitable rudder shaft receiving grommet 38 suitably located and extending therethrough. The rudder 40 has an integrally secured shaft 42 which is long enough to extend up through the grommet 38 and have a T-shaped handle 44 removably keyed and pinned thereon by a pin 46 inserted transversely through aligned transverse apertures 48 and 50 in the rudder shaft 42 and the handle T-stem 52 and be removably held thereon by a spring cap nut 54 that is readily manually removable. The rudder is made of high impact material such as CYCOLAC and may thus be easily assembled for use and knocked down for transportation and storage.

A bottom viewing window 56 is provided in the forward float 12 between the rudder shaft grommet 38 and the torso supporting area 14. The window 56 consists of a bottom transparent plate 58, possibly of PLEXIGLAS, a suitably sized hole 60, and a top transparent plate 62 to keep water from splashing into the hole 60 and onto the bottom transparent plate 58. If desired, a yieldable, cushioned head and face support 64 may be placed about the edge of top transparent plate 62. A compass 65 may be provided near the window 56 for navigation when used as a life raft.

Journaled on the top of elongate male attaching rods 18 is the rider operated propelling means 66, consisting of a pedal crank shaft 68 of metal or high impact plastic journaled in slight recesses 70 on top of male attaching rods 20 and held thereon by journal saddles 72 secured by bolts and nuts 73 through the male rods 20. Suitable TEFLON or other plastic material may line the journal surfaces of saddles 72 and recesses 70 to provide easy rotation of the pedal crank shaft 68, it being obvious that water will add lubrication when in use. The pedal crank shaft 68 may be of metal or high impact synthetic material, such as CYCOLAC.

Journaled on the cranks 74 of crank shaft 68 are foot receiving stirrups 76. Stirrups 76 may consist of upper and lower synthetic material plates 78 and 80 secured together by screws 81 and having complementary semicircular recesses 82, suitably lined to reduce friction, and journaled on cranks 74, the upper plates 78 having semi-flexible stirrup straps 83 through which the rider's feet are placed to operate the crankshaft 68.

The cranks 74 are located between the attaching elongate male mebers 20, and paddle wheels 84 are readily removably secured on the crank shaft ends 86 by pins 88. The hub 92 is externally polygonal in shape, preferably hexagonal. Internally, the hub 92 is complementary to the shape of the crank shaft ends 86. One preferable way is to provide the crank shaft ends 86 with two opposite wings 94 complementary to diametrically located slots 96 keeping the paddle wheels in synchronism.

The externally hexagonal hub 92 has a paddle 98 integrally extending from each hexagonal surface, and the hub 92 and paddles 98 may be integrally molded from a suitable sufficiently rigid plastic material, such as the previously mentioned CYCOLAC. Each paddle 98 is scooped out or hollowed on its under surface 100 with somewhat sharp edges 101, that is, the surface that first enters the water as the scooter 10 is propelled in a forward direction. It is the forward tip 102 that first enters the water because the rear hub attached end is preferably above the water line as the forward tip 102 enters the water. With this construction, a very efficient paddle wheel 66 is provided, such that the paddles 98 cut into the water, rather than slap it, and the scooped or hollowed surfaces 100 push efficiently through the water.

Another feature may optionally be provided. Canopy hole receiving grommets 104 are provided in the forward float 12 on opposite sides of the rudder grommet 38. These grommets 104 will be internally keyed, complementary to the canopy vertical pole lower ends 106 of right angle canopy pole legs 108. Legs 108 extend vertically, while the other legs 110 extend horizontally to receive tubular side edges 112 of a canopy 114. Hooks 116 on the canopy pole leg 110 adjacent the right angle cooperate with canopy hooks engaging grommets 118 to detachably hold the canopy 114 in sun shading position over at least the torso of the rider.

To avoid metal corrosion, high impact synthetic plastic material will be used where possible, particularly for the rods, the rudder and rudeer handle, the canopy poles, the paddle wheels and the pedal crank shaft and stirrups. As already related, one such suitable high impact synthetic plastic material may be CYCOLAC as already mentioned, while the journal bearings may be lined with TEFLON to reduce friction.

OPERATION OF THE INVENTION

In operation, the paddle wheels 84 and rudder 40 and its parts may be stored in the trunk when knocked down for easy transportation or storage, but, when convenient, it may be left fully assembled ready for use, particularly when used in a home pool, or when carried on a boat as a life raft when enough space is available on the boat.

If knocked down, the floats 12 and 16 are manually joined together by inserting the male rods 20 into the female rods 18, depressing the buttons 28 until it is adjusted to the proper size. The rudder shaft 42 is inserted through its grommet 38 and then the T-handle 44 is pinned thereto in keyed position. The paddle wheels 84 are placed on the crank shaft ends 86 and pinned thereto, and the life raft or water scooter 10 is ready for use. If the canopy 114 is to be used, the canopy poles 108 are inserted in their grommets 104, the canopy has its tubular edges 112 extended over the horizontal canopy rods 110 and the grommets 118 are hooked over the canopy pole hooks 116. Of course, the scooter 10 may be used with or without the canopy. The rider then lies on the torso front float, and puts his feet in the stirrups 76 and is ready to travel or exercise in the water.

ABSTRACT OF THE DRAWINGS

In the drawings, like numbers refer to like parts, and for the purpose of explication, set forth below are the numbered parts of the improved KNOCKDOWN READILY PORTABLE RIDER PROPELLED WATER SCOOTER

12 torso supporting forward float
14 bevelled torso supporting rear edge of 12
16 rear float
18 elongate female attaching rods
20 elongate male attaching rods 22 trunk space in rear float 20
24 lid on trunk 22
25 forward beveled edge on bottom of rear float 16
26 beveled outer forward float beveled edges
28 depressible securing button in 20
30 beveled forward float bottom edge
36 apertures in female attaching rods 18
38 rudder shaft receiving grommet
40 rudder
42 rudder shaft
44 T-shaped rudder handle
46 pin for 44 to 42
48 pin receiving apertures in rudder T-handle
50 pin receiving aperture in 42
52 T-stem of 44
55 spring nut on pin 46
56 window
58 window bottom transparent plate
60 window hole
62 top window plate
64 cushioned face and head support on window 56
65 compass
66 rider operated propelling means
68 pedal crank shaft
70 recess in top of male attaching rod 20
72 journal saddles for crank shaft
73 bolts and nuts securing saddles 72 to 20
74 cranks
76 stirrups
78 stirrup upper plate
80 stirrup lower plate
81 securing screws for 78 and 80
82 plate complementary semi-circular recesses
83 stirrup feet securing straps
84 paddle wheels
86 crank shaft ends
88 pins for 86
92 paddle wheel hexagonal hub
94 wings on shaft ends 86
96 wing receiving slots
98 propelling paddles
100 paddle scooped out surface
101 sharp edges of 100
102 tip of paddle 98
104 canopy receiving grommet in float 12
106 lower ends of canopy pole vertical legs 108
108 verticle legs of canopy pole
110 horizontal legs of canopy pole
112 tubular side edges of canopy 114
114 canopy
116 hooks on 108
118 canopy hook engaging grommets Although this invention has been described in considerable detail, such description is intended as being illustrative rather than limiting, since the invention may be variously embodied.

Having thus described the nature of this invention, what is claimed is:

1. A knockdown readily portable rider propelled water scooter (10) comprising a torso supporting forward float (12) and a longitudinally spaced rearward float (16), said floats comprising rigid bouyant material, means for adjustably attaching said floats together comprising U-shaped rods (18, 20) having their U-bights secured and embedded within each said float and having complementary transversely spaced male and female leg means extending beyond its said float toward said other float, said male leg means (20) of one float (16) being telescopable into said female leg means (18) of said other float (12), means (28, 36) in said telescoped leg means detachably and adjustably securing said telescoped leg means together thereby holding said floats in secure adjusted position relative to each other, and scooter propelling means (66) journaled on said extending leg means between said floats.

2. The scooter of claim 1, each said float being of bouyant molded material, said U-bights bein each molded in secure position within its said bouyant float, said propelling means (66) comprising pedal means (74) journaled on and between said float attaching leg means, and paddle wheel means (84) secured on said pedal means externally of said transversely spaced float attaching leg means (18, 20).

3. The scooter of claim 2, and foot stirrup means (76) journaled on said pedal means (74) between said float attaching leg means.

4. The scooter of claim 2, said paddle wheel means (84) comprising a hexagonal shaped wheel hub (92) and a paddle (98) extending from each of the hexagonal surfaces of said wheel hub, said paddle being scooped inwardly and rearwardly of its water contacting side edges (101), said water contacting edges being somewhat sharp.

5. The scooter of claim 1 and manually operable scooter rudder means (40) journaled (38) vertically through said forward float (12) forward of its torso supporting area (14).

6. The scooter of claim 5, and canopy pole ends (106) mounting grommets (104) secured in the forward area of said torso forward supporting float (12) on opposite sides of the journal means (38) of said rudder means (40).

7. The scooter of claim 6, and upwardly and rearwardly extending canopy supporting poles (108, 110) removably securable in said canopy mounting grommets (104).

8. The scooter of claim 1, said torso supporting float (12) having a rearwardly downwardly beveled edge (14) between said float attaching means (18, 20) providing a torso supporting area.

9. The scooter of claim 1, said male and female leg means adjustable securing means comprising a yieldably pressured button (28) projecting from each said male leg means (20) through a selected one of a plurality of longitudinally spaced button receiving apertures (34) in said female leg means (28).

10. The scooter of claim 1, and a trunk space (22) hollowed out in said rear float (16), and a lid (24) for closing said trunk space (22).

* * * * *